US006112830A

United States Patent [19]

Ziegler et al.

[11] Patent Number: 6,112,830

[45] Date of Patent: Sep. 5, 2000

[54] DRILL HAMMER

[75] Inventors: Peter Ziegler; Stephan Kuchinke, both of Nürtingen, Germany

[73] Assignee: Metabowerke GmbH & Co., Nürtingen, Germany

[21] Appl. No.: 09/435,349

[22] Filed: Nov. 8, 1999

[30] Foreign Application Priority Data

Nov. 11, 1998 [DE] Germany ..... 198 51 888

[51] Int. Cl.[7] ..... B25D 11/04

[52] U.S. Cl. ..... 173/109; 173/201

[58] Field of Search ..... 173/104, 109, 173/201, 205, 48, 47

[56] References Cited

U.S. PATENT DOCUMENTS

| | | | |
|---|---|---|---|
| 4,284,148 | 8/1981 | Wanner et al. | 173/201 |
| 4,719,976 | 1/1988 | Bleicher et al. | 173/201 |
| 5,052,497 | 10/1991 | Houben et al. | 173/109 |
| 5,125,461 | 6/1992 | Hoser | 173/48 |
| 5,379,848 | 1/1995 | Rauser | 173/109 |
| 5,435,397 | 7/1995 | Demuth | 173/201 |

*Primary Examiner*—Scott A. Smith

[57] ABSTRACT

The invention concerns a drill hammer having an air cushion percussion mechanism with which an energizing bushing (24) is disposed concentric to the drill tool axis (10) and forms a cavity (26) containing the air cushion in which a percussion piston (28) can move back and forth, and with a wobble drive device (34) for moving the energizing bushing (24) back and forth in the direction of the drill tool axis (10), the rotation element (36) of which driving the nutating disk (42) being disposed for rotational drive parallel to the drill tool axis (10) at a separation therefrom. In order to increase the smoothness of running of the drill hammer, a weight (50) is disposed under restrictive guidance for linear back and forth motion parallel to the drill tool axis (10) in response to the action of the nutating disk (42), at that side of the nutating disk (42) lying diametrically across from the energizing bushing (24).

11 Claims, 2 Drawing Sheets

DRILL HAMMER

This application claims Paris Convention priority of DE 198 51 888.9 filed November 11, 1998 the complete disclosure of which is hereby incorporated by reference.

BACKGROUND OF THE INVENTION

The invention concerns a drill hammer having an air cushion percussion mechanism with which an energizing bushing, forming a cavity for the air cushion and within which a percussion piston can be moved back and forth, is disposed concentric to the bore tool axis, and with a wobble drive device for displacing the energizing bushing back and forth in the direction of the drill tool axis, the rotation element of which driving the nutating disk being disposed for rotational drive parallel to the drill tool axis at a separation therefrom.

The expression wobble drive device refers to a rotation-translation converter with which the rotating motion of a drive sided element is transformed into a linear translational motion of a driven element. Towards this end, a rotation element acts on a nutating element subsequently designated as a nutating disk in such a fashion that it can be driven to exercise a toggling motion for setting an additional element into linear translational motion.

A drill hammer of the above kind has been described in DE 196 51 828 A1 (Bosch). Departing therefrom it is the underlying purpose of the invention to reduce the vibrational shaking related to the acceleration and deceleration of masses occurring in the conventional drill hammer and the associated handling difficulties.

SUMMARY OF THE INVENTION

This purpose is achieved with a drill hammer of the above mentioned kind in accordance with the invention in that a weight is guided in a restricted manner linearly and parallel to the drill tool axis at that side of the nutating disk lying across from the energizing bushing and is moved back and forth under the action of the nutating disk.

This weight constitutes a counter weight to produce a load moment in response to the moving masses and momenta occurring in consequence of the energizing bushing motion. In accordance with the invention, one has discovered that a substantial increase in the smoothness of running can be achieved using the linearly moving weight and, in fact, to a greater extent than can be achieved by increasing the mass of the nutating disk at the corresponding side. This is due to the fact that optimal counter balancing cannot be achieved in this case, since the local mass increase on the nutating disk would not lead to linear, rather to pendulating motion along with the nutating disk, in contrast to the relationships on the percussion tool side where the energizing bushing is likewise provided with linear motion.

The restricted guidance of the weight is advantageously effected by a component of the drill hammer fixed to the housing during operation. In accordance with a preferred embodiment of the invention, the restricted guidance is formed by at least one linear rod mounted to a component fixed to the housing and engaging into a guiding recess extending linearly in the direction of motion. This linear guiding recess could e.g. be a bore hole in the weight. It has however turned out to be advantageous when the weight guide recess is a recess at the edge thereof which is open, since in this event the restricted guidance can be effected on the outer sides of the weight. This leaves room within the weight for configuring the coupling to the nutating disk.

In a further improvement of the invention, the rod constituting the restricted guidance is advantageously a round rod. The rod can be shorter than the longitudinal extent of the weight and could e.g. be disposed in the central region of the weight only. However, it has turned out to be advantageous when the rod has a length which exceeds that of the weight, wherein the rod is held at its ends to a component fixed to the housing. In this fashion, an increasing guiding length as well as a simple assembly is effected for the weight.

In addition, it has turned out to be advantageous when the weight is substantially cuboid in shape. In this case it can be disposed in a substantially cuboid shaped region preferentially provided below the percussion tool. Providing space for the weight in this region is easily done and does not cause complications. The coupling of the weight to the nutating disk can be effected in an arbitrary manner so that the pendulating motion of the nutating disk can be transformed into a linear back and forth motion of the weight. Towards this end, it has turned out to be advantageous when the weight has an opening for accepting a radial extension of the nutating disk. The radial extension can thereby be integral with the nutating disk or it could be a shoulder introduced thereon in an arbitrary fashion. Clearly, instead of an opening in the weight, a dome shaped coupling shoulder member can be provided on the weight. However, the configuration of an opening is simpler from a production point of view and above all, saves space. The radial coupling extension on the nutating disk is advantageously shaped in the form of a spherical head and thereby includes a tapering towards the nutating disk. This simplifies coupling to the weight.

Additional details, features and advantages of the invention can be derived from the drawing and the subsequent description of a preferred embodiment of the drill hammer in accordance with the invention.

DESCRIPTION OF THE PREFERRED EMBODIMENT

Figure 1:
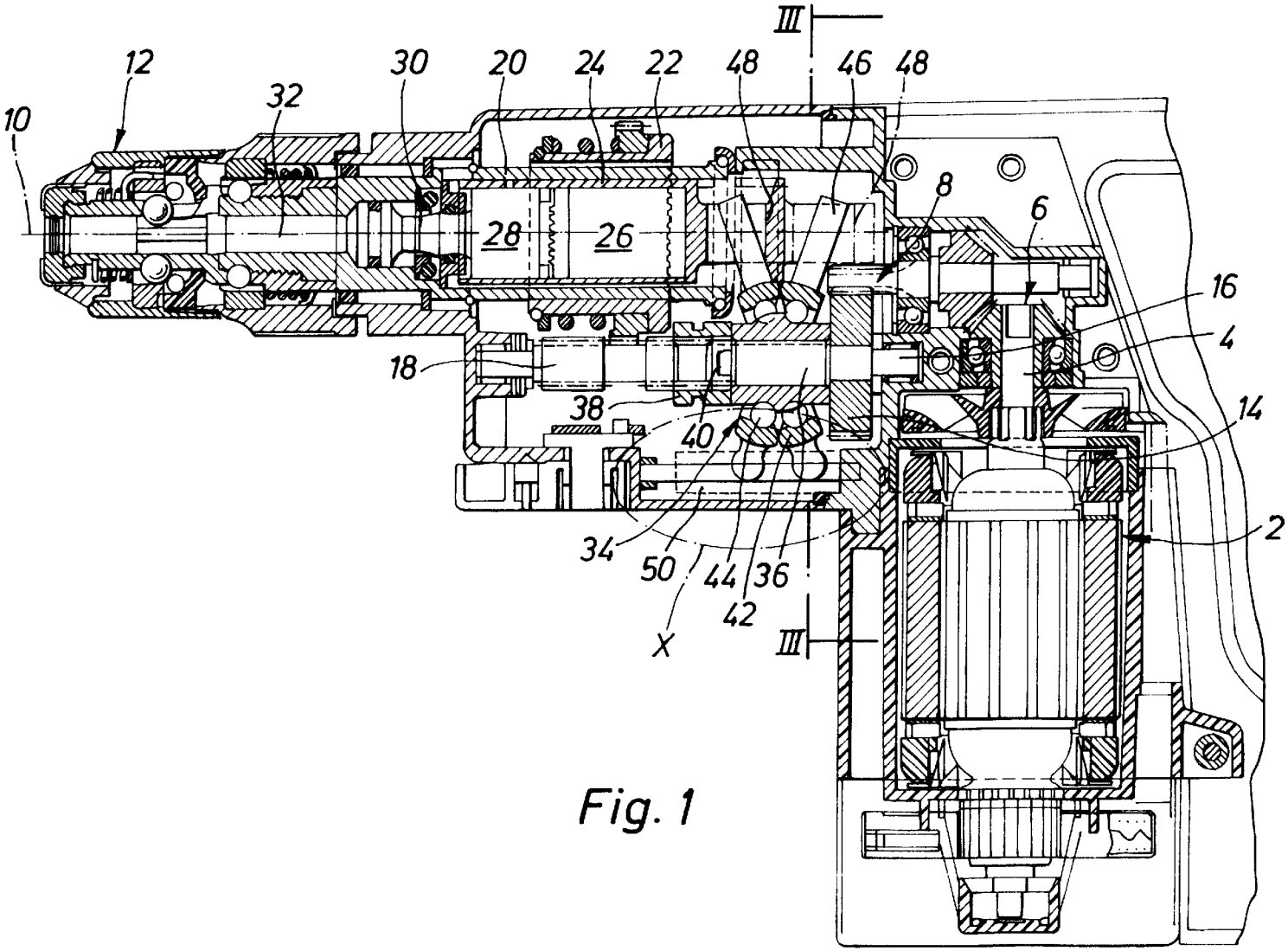
FIG. 1 shows a partial sectional side view of a drill hammer configured in accordance with the invention.
Figure 3:
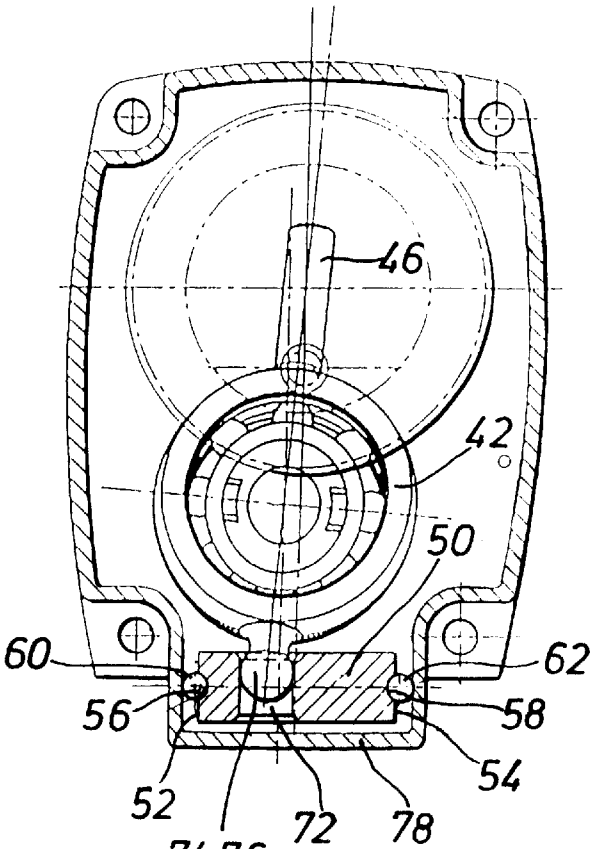
FIG. 3 shows a section of the drill hammer according to FIG. 1 as seen in the direction of arrows III—III.
Figure 2:
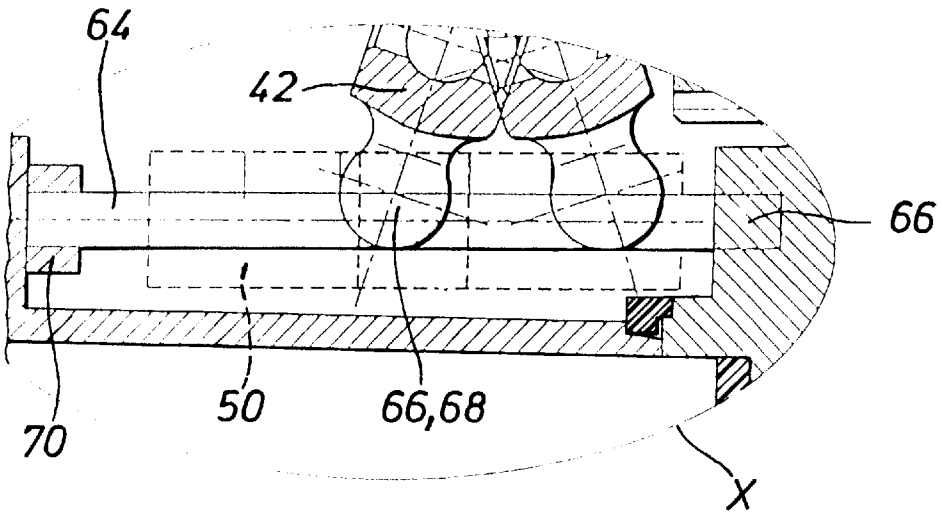
FIG. 2 shows a section of the region "X" of FIG. 1.

FIG. 1 shows a drill hammer configured in accordance with the invention. In the figure, a drive shaft 4 extends from an electrical motor 2 in a vertical direction. A drive deflection through 90° degrees is effected using an angular transmission 6 leading to a pinion 8. The rotational axis of the pinion 8 is parallel to the drill tool axis 10 of a tool which can be inserted at the forward region into a chuck member 12. The tool (not shown) could be a drill tool or even a hammer tool such as a chisel.

The pinion 8 is in combed engagement with a gear 14 which is disposed for secure rotation on and with an intermediate shaft 16 which, for its part, extends in a forward direction parallel to the drill tool axis 10. Another gear 18 is provided for secure rotation on and with a front section of the intermediate shaft 16. An outer bushing 20 is disposed next to the intermediate shaft 16 and concentric with the drill tool axis 10 and is connected for secure rotation to and with the tool. The outer bushing 20 can be brought into or out of driving connection via combed engagement with the gear 18 by means of a coupling element 22 which can be displaced back and forth in the direction of the tool axis 10.

An energizing bushing 24 is provided inside the outer bushing 20 and can be displaced back and forth in the direction of the drill tool axis 10. The energizing bushing 24 defines a cavity 26 which contains an air cushion and accepts a percussion piston 28 in a displaceable fashion along the longitudinal direction of the drill tool axis 10. Back and forth motion of the energizing bushing 24 causes the air cushion to be compressed and relaxed in a conventional fashion to thereby cause the back and forth motion of the percussion piston 26. The forward end 30 of the percussion piston 28 thereby strikes an intermediate plunger 32 which transfers the striking force to a drill tool (not shown).

The back and forth motion of the energizing bushing 24 is effected by means of a wobble drive device 34 which will be described below. The wobble drive device 34 comprises a rotation element 36 which is borne for rotation on and relative to an intermediate shaft 16. The rotation element 36 can be connected for secure rotation to and with the intermediate shaft 16 (hammer operation) through displacement of a coupling bushing 38 which is disposed for secure rotation on and with the intermediate shaft 16 and via a claw coupling 40 on its side facing the coupling bushing 38. The rotation element 36 is surrounded by a nutating disk element 42, wherein rolling members 44 are provided therebetween, such that the rotation element 36 represents the inner casing and the nutating disk 42 the outer casing of a bearing formed thereby. The nutating disk 42 comprises a pin shaped shoulder 46 at its side facing the energizing bushing 24 which engages into an opening 48 in the energizing bushing 24, with the optional intermediate introduction of a spherical bearing.

When the rotational element 36 is coupling for secure rotation to and with the intermediate shaft 16, the nutating disk 42 exercises a pendulating or toggling motion. The pin shaped shoulder 46 thereby exercises a pendulating motion in the plane of the drawing of FIG. 1 as indicated by the doubled representation therein. The energizing bushing 24 follows with a corresponding back and forth motion. The air cushion in the cavity 26 is compressed and decompressed to move the percussion piston 28 back and forth.

A weight 50 is disposed on that side of the nutating disk 42 diametrically opposed to the energizing bushing 24, and is driven by the nutating disk 42 under restricted guidance to exercise a linear back and forth motion parallel to the drill tool axis 10. The restricted guidance is effected by guide recesses 56, 58, having opened edges fashioned in both longitudinal sides 52, 54 of the cuboid shaped weight 50 which have a partial circular cross section and which each accept a rod 60, 62 extending parallel to the tool axis 10 and acting as a longitudinal guiding means. The rods 60, 62 are mounted at their longitudinal ends 64, 66 to a component 68, 70 which is fixed to the housing during operation.

The weight 50 includes an opening 72 configured as a bore into which a coupling member 74, in the form of a spherical shaped extension 76 formed integrally on the nutating disk 42 engages, optionally with an intermediate spherical bearing.

When the energizing bushing 24 is driven during hammer operation by means of the nutating or back and forth toggling motion of the nutating disk 42 and of the shoulder 46, respectively, along the drill tool axis 10 in the backward direction, the weight 50 is simultaneously moved in the forward direction parallel to the drill tool axis 10. In this manner smooth operation can be substantially increased during hammer operation or during combined drilling hammering operation. The weight 50 moves linearly back and forth within cuboid shape section 78 of the machine housing.

We claim:

1. A drill hammer having an air cushion percussion device, the hammer comprising:

a housing having a drill tool axis;

an energizing bushing disposed in said housing concentric with respect to a drill tool axis, said energizing bushing defining a cavity enclosing the air cushion;

a percussion piston disposed in said housing for back and forth motion within said cavity;

a nutating disk disposed in said housing and cooperating with said energizing bushing to displace said energizing bushing back and forth in a direction of the drill tool axis for compressing and decompressing said air cushion to drive said percussion piston back and forth;

a rotation element disposed in said housing parallel to and at a distance from the drill tool axis for rotation to drive said nutating disk;

a weight disposed in said housing to cooperate with said nutating disk, at a side of said nutating disk lying diametrically across from said energizing bushing; and guidance means disposed in said housing to cooperating with said weight for restricting said weight to move linearly back and forth parallel to the drill tool axis in response to action of said nutating disc.

2. The drill hammer of claim 1, wherein said guidance means comprise an element fixed to said housing during operation of the drill hammer.

3. The drill hammer of claim 1, wherein said guidance means comprise at least one linear rod held on a component fixed to said housing, each of said linear rod engaging into an associated guide recess fashioned in said weight and extending linearly in a direction of motion thereof.

4. The drill hammer of claim 3, wherein said guide recess has an open edge.

5. The drill hammer of claim 3, wherein said at least one linear rod is round.

6. The drill hammer of claim 3, wherein said linear rod has a length exceeding a path length traveled through by said weight during its back and forth motion, wherein said linear rod is mounted at its ends to said component fixed to said housing.

7. The drill hammer of claim 1, wherein said weight is cuboid.

8. The drill hammer of claim 1, wherein said housing has a substantially cuboid section within which said weight is disposed.

9. The drill hammer of claim 1, wherein said weight has an opening for accepting one of a radial extension of said nutating disk and a spherical bearing communicating with said nutating disk.

10. The drill hammer of claim 9, wherein said opening is a bore hole.

11. The drill hammer of claim 1, wherein said nutating disk comprises a radial extension having a spherical head cooperating with said weight to move said weight back and forth.

* * * * *